United States Patent [19]

Caveney et al.

[11] 3,965,538

[45] June 29, 1976

[54] INTEGRAL CABLE TIE

[75] Inventors: Jack E. Caveney, Chicago; Roy A. Moody, Flossmoor, both of Ill.

[73] Assignee: Panduit Corporation, Tinley Park, Ill.

[22] Filed: May 5, 1969

[21] Appl. No.: 821,875

[52] U.S. Cl. ..... 24/16 PB

[51] Int. Cl.[2] ..... B65D 63/00

[58] Field of Search ..... 24/73.7, 16 PB, 30.5 PB, 24/206 A, 17 AP, 73 PB, 30.5 P; 248/68, 74, 74 PB

[56] References Cited

UNITED STATES PATENTS

| | | | |
|---|---|---|---|
| 2,484,905 | 12/1969 | Eberhardt | 24/16 PB |
| 2,936,980 | 5/1960 | Rapata | 248/74 PB |
| 3,009,220 | 11/1961 | Fein | 24/16 PB |
| 3,144,695 | 8/1964 | Budwig | 248/74 PB X |
| 3,214,808 | 11/1965 | Litwin | 24/16 PB |
| 3,224,056 | 12/1965 | Joffe | 24/16 PB |
| 3,302,913 | 2/1967 | Collyer et al. | 248/74 PB X |
| 3,339,246 | 9/1967 | Geisinger | 24/16 PB |
| 3,368,247 | 2/1968 | Orban | 24/16 PB |
| 3,471,109 | 10/1969 | Meyer | 248/68 |
| 3,486,201 | 12/1969 | Bourne | 24/16 PB |
| 3,542,321 | 11/1970 | Kahabka | 248/74 PB X |
| 3,660,869 | 5/1972 | Caveney et al. | 24/16 PB |

FOREIGN PATENTS OR APPLICATIONS

| | | | |
|---|---|---|---|
| 209,500 | 8/1957 | Australia | 24/206 A |
| 219,644 | 1/1959 | Australia | 24/16 PB |

*Primary Examiner*—Donald A. Griffin

*Attorney, Agent, or Firm*—Prangley, Dithmar, Vogel, Sandler & Stotland

[57] ABSTRACT

An integral one-piece cable tie including an elongated flexible strap having a row of teeth thereon, a frame integral with one end of the strap and having an abutment wall and an end wall and an entry surface and an exit surface and a strap-receiving opening therethrough, a ledge extending from the end wall, and a pawl pivotally mounted on and integral with the ledge within the opening and having a set of teeth shaped complementary to the row of teeth and defining with the end wall a strap-receiving throat inclined to the longitudinal axis of the strap as molded, the abutment wall having a plurality of strap-gripping projections thereon extending toward the pawl.

22 Claims, 17 Drawing Figures

FIG. 1
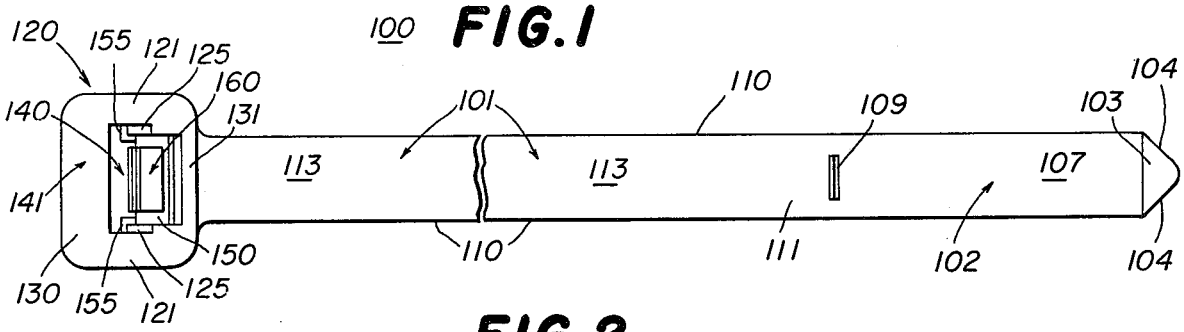
FIG. 2
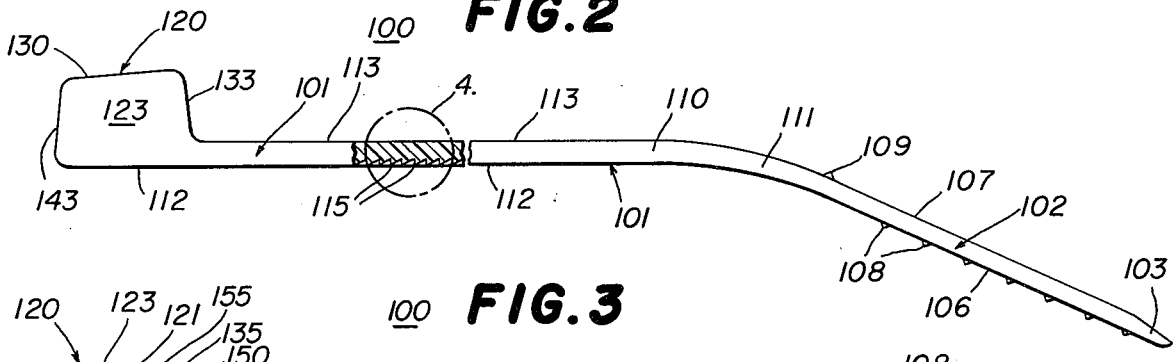
FIG. 3
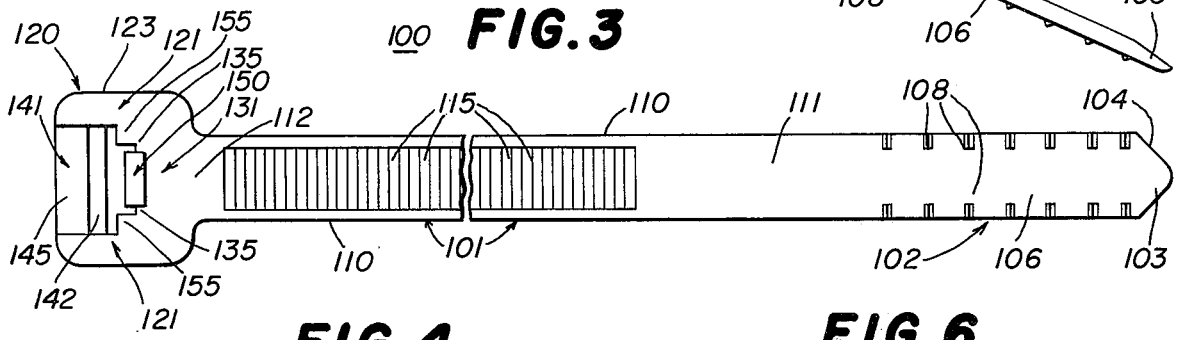
FIG. 4
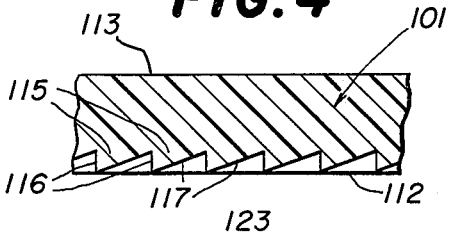
FIG. 6
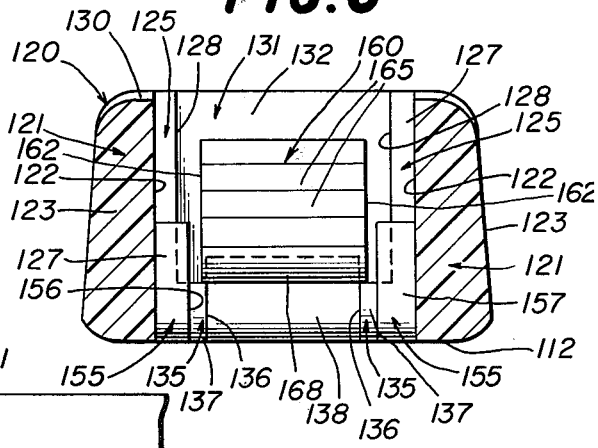
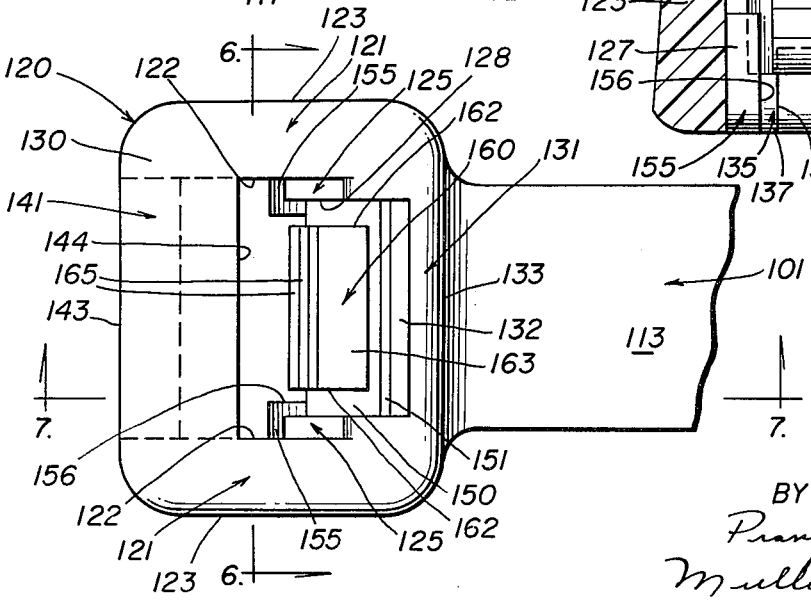
FIG. 5
INVENTORS
JACK E. CAVENEY
ROY A. MOODY
BY
Pringley, Clayton, Mullin & Vogel
ATTYS.

INTEGRAL CABLE TIE

The present invention is directed to an integral one-piece cable tie to be tensioned about a bundle of wires and the like.

It is an object of the invention to provide an integral one-piece cable tie to be tensioned about a bundle of wires and the like, comprising an elongated flexible strap having a row of teeth on one surface thereof, a frame integral with one end of the strap and having an abutment wall and an end wall and an entry surface and an exit surface and a strap-receiving opening therethrough, a ledge on the end wall extending longitudinally therefrom toward the abutment wall, a pawl disposed within the frame in the strap-receiving opening between the ledge and the exit surface, an essentially rigid non-collapsible hinge interconnecting the ledge and the end of the pawl disposed toward the entry surface, the pawl and the hinge cooperating so that the pawl is limited to only pivotal movement with respect to the frame about the connection to the ledge, the pawl in the as-molded position thereof and in all other positions thereof including the tensioned position thereof being disposed entirely within the frame between the entry and exit surfaces thereof, the abutment wall having a strap-bearing surface disposed toward the pawl and defining therewith a strap-receiving throat, and a set of teeth on the pawl arranged transversely with respect thereto and disposed toward the abutment wall and shaped complementary to the row of teeth on the strap.

Another object of the invention is to provide a cable tie wherein the portion of the abutment wall disposed toward the entry surface and the longitudinal axis of the strap-receiving throat and the plane containing the crests of the set of teeth are all inclined at acute angles less than 90° with respect to the longitudinal axis of the strap as molded, the portion of the strap-bearing surface disposed adjacent to the exit surface being relieved at least to a plane substantially normal to the longitudinal axis of the strap as molded and spaced from the pawl so that a plurality of the set of teeth are opposite the inclined portion of the strap-bearing surface.

Another object of the invention is to provide a cable tie of the type set forth, wherein the crests of a plurality of the teeth in the set of teeth are positioned opposite the strap-bearing surface and lie in a common surface that is disposed substantially equidistantly from the strap-bearing surface, the strap-bearing surface extending beyond the plurality of teeth, the planes defined by the surfaces of the set of teeth disposed toward the entry surface in the tensioned condition converging with the planes defined by the surface of the pawl disposed toward the exit surface and away from the abutment wall in the tensioned condition at points disposed on the exit side of the frame at angles as small as zero degrees.

Another object of the invention is to provide a cable tie wherein a plurality of strap-gripping projections is provided on the strap-bearing surface and extend toward the pawl, whereby any force tending to withdraw the strap from within the strap-receiving throat in a strap-loosening direction serves to move the set of teeth into more firm engagement with the engaged ones of the row of teeth and to press the strap-gripping projections against the strap.

A further object of the invention is to provide a cable tie of the type set forth, wherein rails are provided respectively disposed on the frame adjacent to the end wall and extending into the strap-receiving opening at positions to guide the strap along a path adjacent to the strap-bearing surface.

Further features of the invention pertain to the particular arrangement of the parts of the cable tie, whereby the above-outlined and additional operating features thereof are attained.

The invention, both as to its organization and method of operation, together with further objects and advantages thereof, will best be understood by reference to the following specification taken in connection with the accompanying drawings, in which:

FIG. 1 is a plan view with certain of the parts broken away of an integral one-piece cable tie made in accordance with and embodying the principles of the present invention;

FIG. 2 is a side elevational view with certain parts broken away of the cable tie of FIG. 1;

FIG. 3 is a plan view with certain parts broken away of the reverse side of the cable tie of FIGS. 1 and 2;

FIG. 4 is an enlarged fragmentary view in cross section of the portion of FIG. 2 within the circle designated by the reference numeral "4";

FIG. 5 is an enlarged fragmentary plan view of the frame forming a part of the cable tie of FIGS. 1–3;

FIG. 6 is a view in vertical section along the line 6—6 of FIG. 5;

Figures 7, 8, 9, 10:
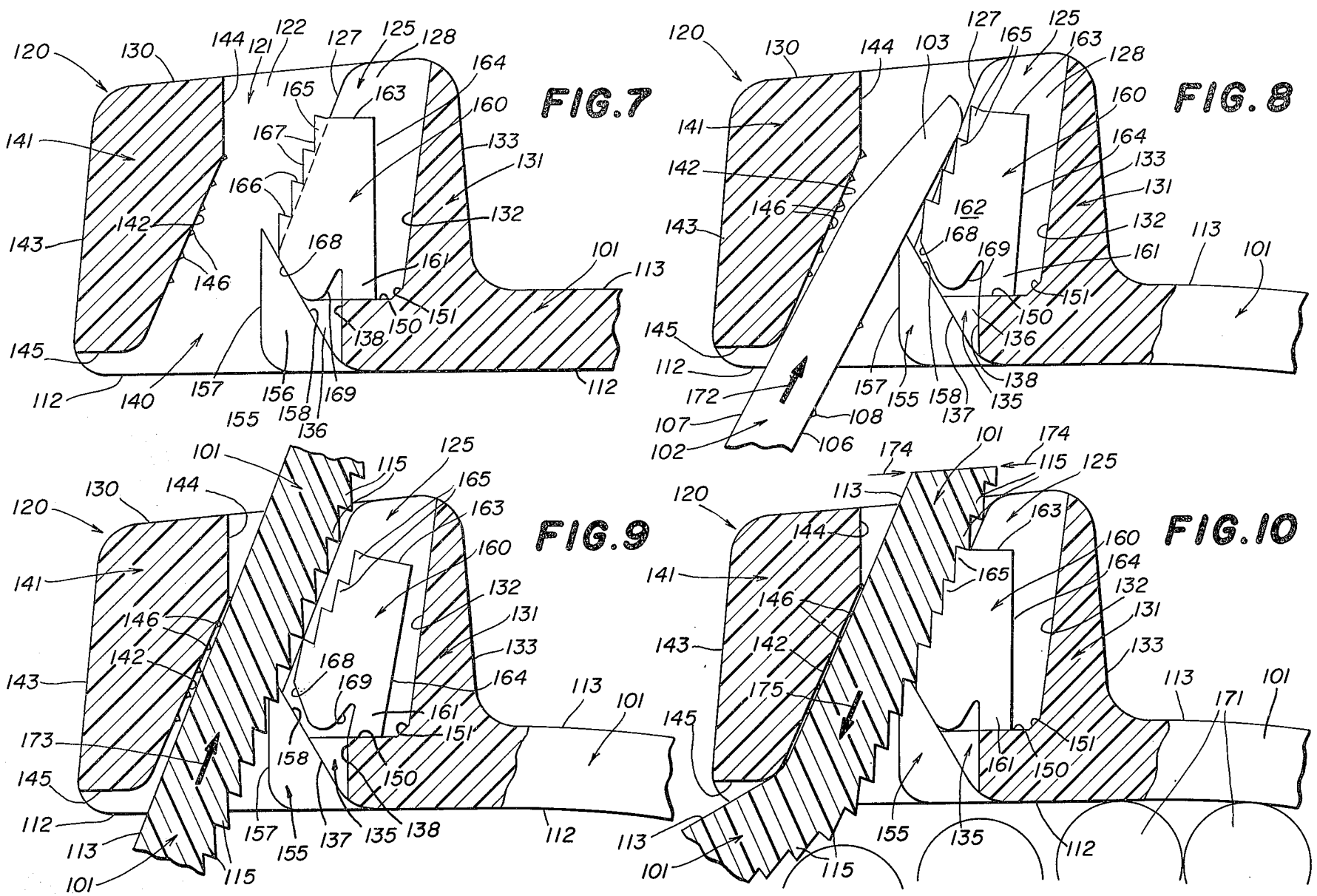
FIG. 7 is a further enlarged fragmentary view in vertical section along the line 7—7 of FIG. 5.
Figure 12:
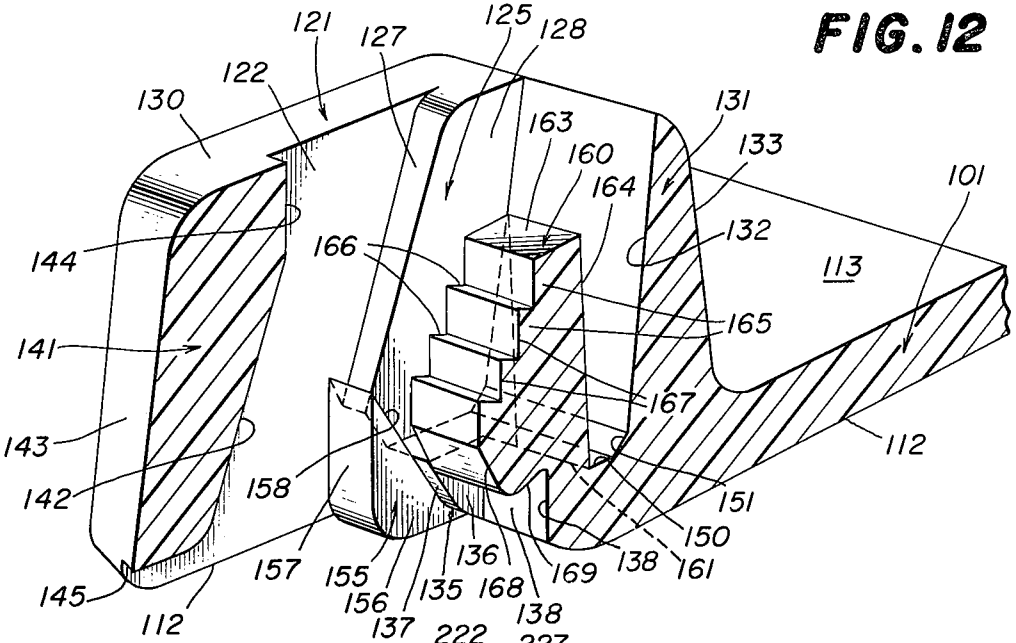
Figure 13:
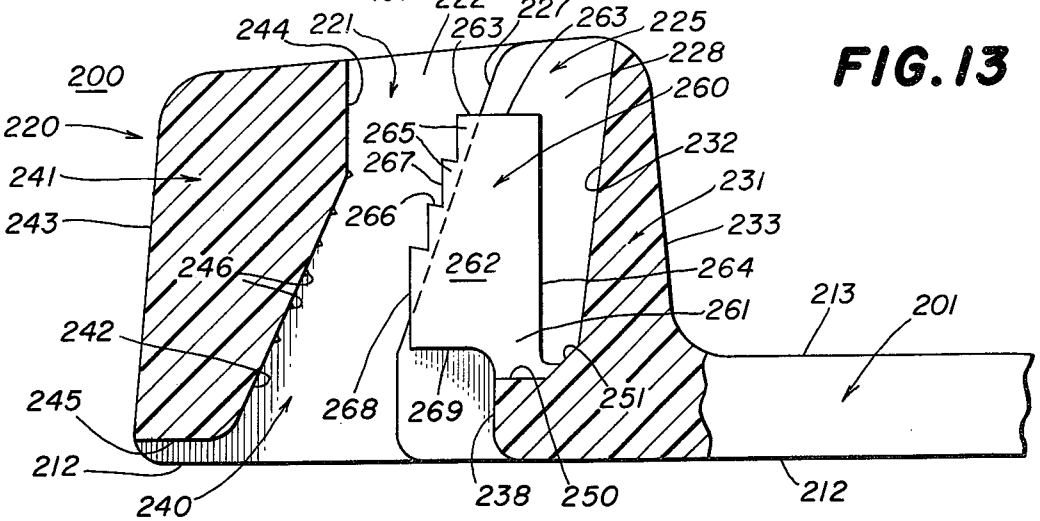
Figure 11:
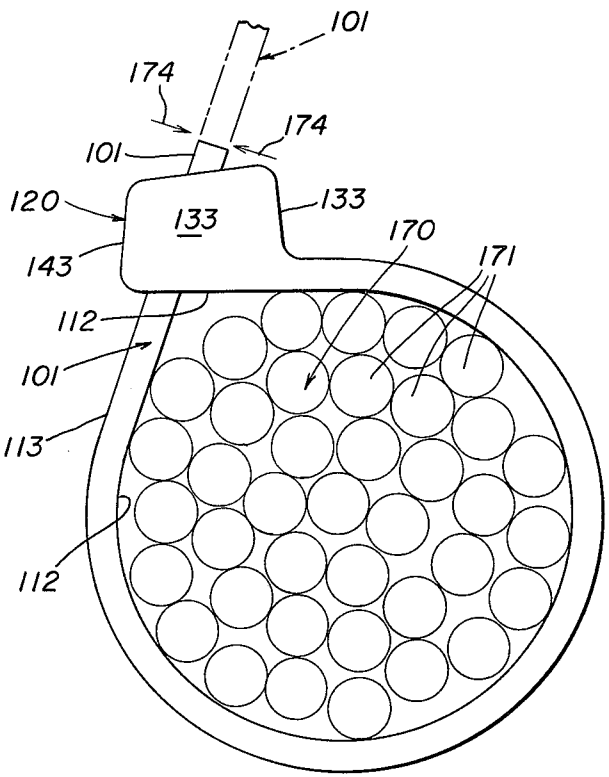
Figure 14:
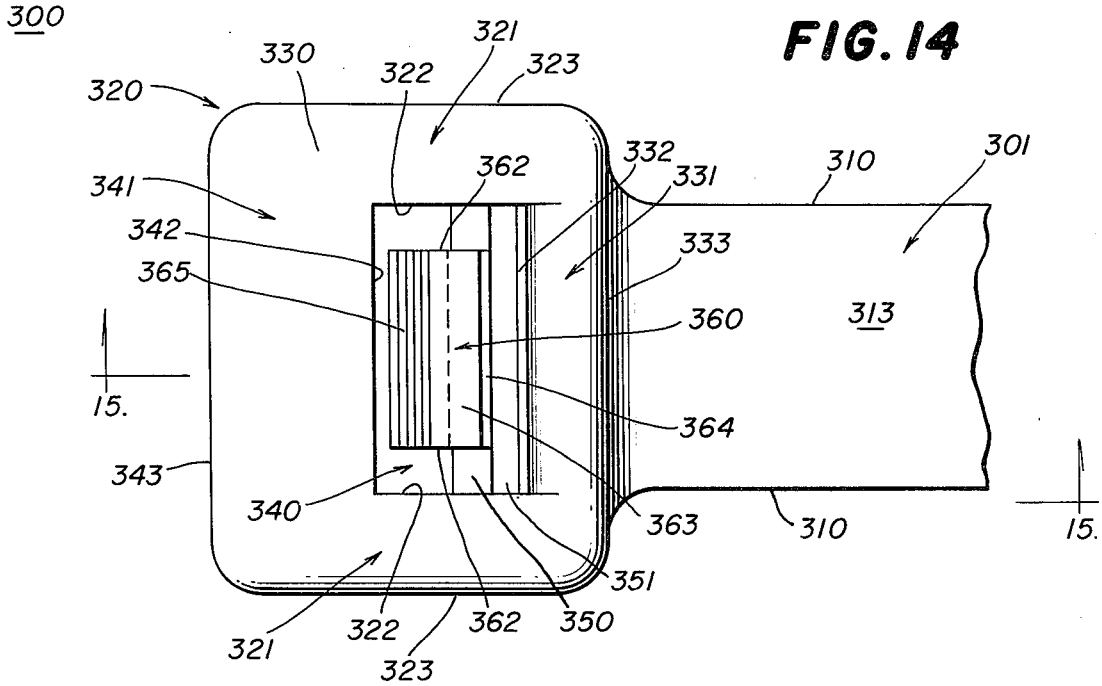
Figure 15:
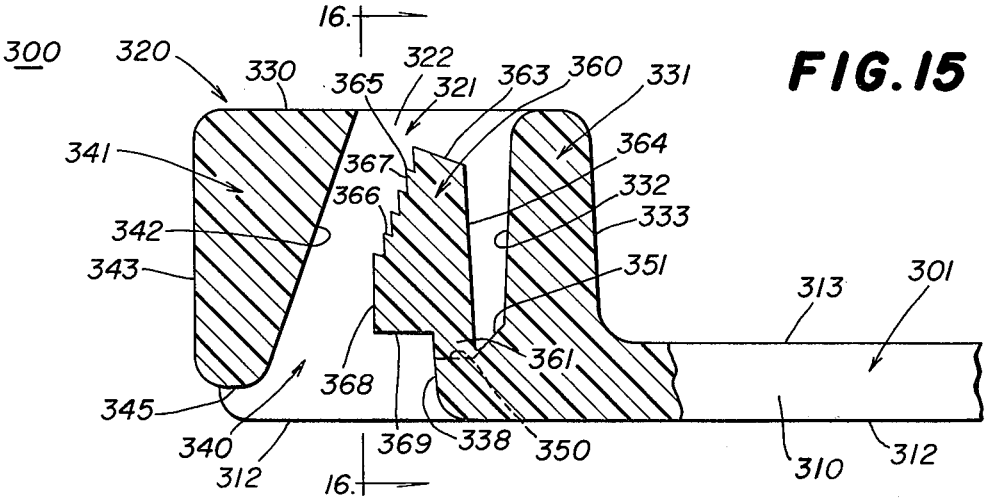
Figure 16:
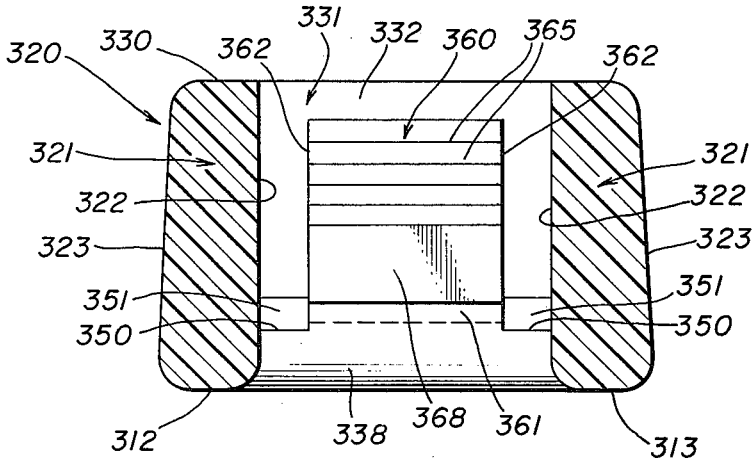

FIGS. 8 to 10, inclusive, are diagrammatic views illustrating the application of the cable tie of FIGS. 1 to 3 about a bundle of wires;

FIG. 11 is a view illustrating the cable tie of FIGS. 1 to 3 applied about a bundle of wires;

FIG. 12 is an enlarged perspective view with certain parts broken away of the frame of the cable tie of FIGS. 1 to 3;

FIG. 13 is a view similar to FIG. 7 of a second form of cable tie made in accordance with the present invention;

FIG. 14 is an enlarged fragmentary plan view of the frame forming a part of a third form of cable tie made in accordance with the present invention;

FIG. 15 is a view in vertical section along the line 15—15 of FIG. 14; and FIG. 16 is a view in lateral section along the line 16—16 of FIG. 15.

Referring to FIGS. 1 to 3 of the drawings, there is shown a first preferred embodiment of an integral one-piece cable tie made in accordance with and embodying the principles of the present invention. The cable tie 100 includes generally a strap 101 carrying on one end thereof a frame or head 120 having a strap-receiving opening or throat 140 therethrough in which is disposed a pawl 160. The cable tie 100 is typically used to bind a bundle 170 formed of a plurality of wires 171, and accordingly, the cable tie 100 has been illustrated in this end use in FIG. 11. However, it will be appreciated that the cable tie 100 can be advantageously used to bind other objects in a like manner.

A preferred material of construction of the cable tie 100 is a suitable synthetic organic plastic resin, the preferred resin being one of the polyamide resins; the resin must be sufficiently flexible to accommodate the deformation of the several parts of the cable tie 100 as illustrated throughout the drawings. It is an important object of the invention that each of the parts of the cable tie 100 is integral with the adjacent parts thereof, whereby the cable tie 100 is truly one-piece and formed integral throughout.

The strap 101 is elongated and flexible and includes an outer end 102 which extends downwardly as viewed in FIG. 2 with respect to the remaining portion of the strap 101 as molded, the outer end 102 carrying thereon a tip 103 provided with tapered sides 104. The outer end 102 further has an inner or bundle engaging surface 106 and an outer surface 107, the inner surface 106 carrying a plurality of transversely spaced-apart pairs of gripping projections 108 equidistantly spaced along the length of the outer end 102. A high ridge or detent 109 is provided on the outer surface 107 and is arranged transversely with respect thereto and adjacent to the juncture 111 between the outer end 102 and the remaining portion of the strap 101. In use, the detent 109 is caused to engage the strap 101 on the frame 120 temporarily in an encircling position with respect to an associated bundle 170, all as will be explained more fully hereinafter.

The strap 101 further includes a pair of longitudinally extending strap sides 110 which extend the length of the strap 101, and there is provided on the portion of the strap 101 disposed between the juncture 111 with the outer end 102 and the juncture with the frame 120 an inner or bundle-engaging surface 112 and an outer surface 113. Disposed in the surface 112 is a row of abutments as teeth 115 (see FIG. 4 also), the teeth 115 being disposed in a recessed position with respect to the surface 112 and extending laterally of the strap 101 and having a length slightly less than the width of the surface 112, whereby to be confined completely within the body of the strap 101. As illustrated, each of the teeth 115 has a shorter side 116 disposed substantially normal to the adjacent strap surface 112 and a longer or inclined side 117.

The frame 120 is integral with the strap 101 and comprises a pair of side walls or members 121, a rear wall or member 131 and a front wall or member 141. As may be best seen in FIG. 6, the side walls 121 are laterally spaced apart and include inner surfaces 122 that extend the full height of the frame 120 and are disposed essentially parallel to one another, the inner surfaces 122 more specifically extending from the inner surface 112 which serves as an entry surface for the frame 120 to an exit surface 130 on the top of the frame 120 as viewed in FIG. 6. The inner surfaces 122 further are spaced apart a distance greater than the distance between the strap sides 110, whereby the strap 101 may be received between the inner surfaces 122, all as will be explained more fully hereinafter. Each of the side walls 120 further includes an outer surface 123 that extends from the entry surface 112 to the exit surface 130.

Provided on each of the side walls 121 is a rail generally designated by the numeral 125, the rails 125 extending laterally inwardly toward one another and having inclined surfaces 127 disposed essentially normal to the inner surfaces 122 and having inner surfaces 128 facing one another and disposed essentially parallel to the inner surfaces 122. The rails 125 serve to guide the strap 101 along a predetermined path through the frame 120, all as will be explained more fully hereinafter.

The rear wall or end wall 131 includes an inner surface 132 and an outer surface 133, the inner surface 132 diverging downwardly away from the outer surface 133 from the exit surface 130 to the entry surface 112, whereby the rear wall 131 is thicker at the bottom thereof than at the top thereof, all as is illustrated in FIG. 7. It further is pointed out that the strap 101 is joined to the frame 120 at the lower and thicker portion of the end wall 131.

The front wall or abutment wall 141 has an inner surface which includes a lower inclined surface 142, an upper relieved surface 144, both of which surfaces are spaced from the rear wall 131 in the direction opposite to the strap 101. The inner surface 142 is inclined at an angle of about 66° from the entry surface 112 toward the exit surface 130 with respect to the longitudinal axis of the strap 101 as molded, the abutment wall 141 and the pawl 160 cooperating to provide therebetween a strap-receiving opening 140 that has the longitudinal axis thereof generally parallel to the strap-bearing surface 142. The relieved surface 144 is disposed essentially normal to the longitudinal axis of the strap 101 as molded and is spaced from the pawl 160 in the direction away from the strap 101 and is shaped to facilitate better cut off of the cable tie 100. More specifically, the surface 144 is in the form of a plane disposed substantially normal to the longitudinal axis of the strap 101 as molded, but may be inclined upwardly and away from the strap 101, whereby the surface 144 is relieved at least to a plane substantially normal to the longitudinal axis of the strap 101 as molded and spaced from the pawl 160. The front wall 141 also has an outer surface 143 which extends downwardly from the exit surface 130 and terminates a short distance away from the entry surface 112 and joins thereat a guide surface 145 which connects the inner surface 142 and the outer surface 143. More specifically, the guide surface 145 is spaced away from the entry surface 112 and together with the inner surfaces 122 of the side walls 121 defines a strap-receiving channel in the frame 120. The channel thus provided in the frame 120 and beneath the front wall 141 permits the frame 120 to lie more closely against the associated bundle 170 when the parts are in the tensioned condition as illustrated in FIGS. 10 and 11. In passing, it is noted that the exit surface 130 is inclined with respect to the entry surface 112 and the longitudinal axis of the strap 101 as molded, and more specifically slopes downwardly toward the entry surface 112 in a direction away from the strap 101.

There is provided on the strap-bearing surface 142 a plurality of transversely arranged and longitudinally spaced-apart strap-gripping projections 146. The projections 146 have a length slightly less than the width of the strap 101 and are urged into the adjacent surface 113 of the strap 101 in the tightening of the cable tie 100 about the associated bundle 170.

Extending between the rails 125 adjacent to the lower portion of the end wall 131 is a ledge 150, the ledge 150 being essentially rectangular and directed toward the front wall 141 and disposed substantially parallel to the entry surface 112 and the longitudinal axis of the strap 101 as molded. The transverse edge of the ledge 150 disposed toward the strap 101 joins an upwardly inclined surface 151 that connects with the inner surface 132 on the rear wall 131. A surface 138 interconnects the entry surface 112 and the edge of the central portion of the ledge 150 disposed toward the front wall 141, the side edges of the surface 138 are connected with projections 135 having surfaces 136 that extend upwardly and join the inner surface of the ledge 150. Disposed at the ends of the ledge 150 disposed toward the front wall 141 are inwardly extending projections 155, respectively, the projections 155 having inwardly facing parallel surfaces 156 disposed parallel to the surfaces 122, 128 and 136 and generally triangular in shape and joined to the surfaces 136 by surfaces 137, respectively. Disposed toward the front wall 141 on each of the projections 155 is a surface 157 extending substantially normal to the entry surface 112 and joined thereto by a curved portion, the upper ends of the surfaces 157 extending upwardly beyond the lower ends of the rail surfaces 127. Extending upwardly from the forward ends of the ledge 150 and on the projections 155 are inclined surfaces 158 that interconnect the ledge 150 and the associated surface 157. It is pointed out that the upwardly disposed pointed portions defined by the surfaces 156, 157 and 158 are spaced a distance less than the thickness of the strap 111 from the abutment wall 142, but are sufficiently flexible to be deformed out of the path thereof during insertion of the strap 101 through the frame 120.

Mounted within the strap-receiving opening 140 in the frame 120 is a pawl 160, the pawl 160 being connected to and mounted on the ledge 150 by means of a rigid noncollapsible hinge 161, the hinge 161 being essentially rectangular in cross section. The pawl 160 has a pair of side surfaces 162 disposed substantially parallel to each other (see FIGS. 5 and 6), the side surfaces 162 being spaced apart a distance slightly less than the transverse dimensions of the teeth 115 on the strap 101. The pawl 160 also has a top surface 163 (see FIG. 7) and a rear surface 164 disposed toward the inner surface 132. A set of teeth 165 is provided on the surface of the pawl 160 disposed toward the front wall 141, the teeth 165 each having a shorter side 166 and a longer inclined side 167. The crests of the teeth 165 all lie in a common plane which is essentially parallel to the opposed inner surface 142 on the front wall 141 as molded; and the roots of the teeth 165 on the pawl 160 also lie in a common plane that is essentially parallel to the opposed inner surface 142 on the front wall 141 as molded. Furthermore, the crest-to-crest distance of the pawl teeth 165 is slightly less than the crest-to-crest distance of the strap teeth 115, whereby to insure that all of the teeth 165 on the pawl 160 engage teeth 115 on the strap 101, all as will be explained more fully hereinafter. The pawl 160 further has a lower inclined surface 168 that extends downwardly and joins an upwardly inclined surface 169 disposed toward the hinge 161, whereby to define the portion of the pawl 160 disposed forwardly of the hinge 161. More particularly a recess is defined by the surfaces 136 and by the forward surface of the hinge 161 and the surface 169, the resultant shape of the pawl 160 and the hinge 161 providing for good locking action.

In use, the cable tie 100 is encircled about a bundle 170 of wires 171 as illustrated in FIG. 11. Prior to such encirclement of the bundle 170, the frame 120 and the several parts associated therewith including the pawl 160 are in the positions shown in FIG. 7, i.e., in the as-molded condition thereof. It will be noted that the crests of the teeth 165 lie in a plane that is essentially parallel to the inner surface 142 of the front wall 141 while the surface 144 is relieved forwardly from the plane defined by the surface 142, several of the teeth 165 however, being disposed opposite the inclined surface 142 and the projections 146 thereon.

The first step in applying the cable tie 100 about the bundle 170 is to insert the outer end 102 into the frame 120 in the direction of the arrow 172 in FIG. 8. If desired, the detent 109 may be caused to engage the juncture between the surfaces 142 and 144 temporarily to hold the strap 101 about a group of wires 171. In this manner, the workman can continue to add wires 171 to the bundle 170 or remove wires 171 therefrom, if required, all before locking engagement of the strap teeth 115 with the pawl teeth 165.

Thereafter, the user grasps the strap end 102 utilizing the projections 108 and pulls the strap 101 further through the frame 120 in the direction of the arrow 173 in FIG. 9. The rows of projections 108 are spaced apart a distance greater than the width of the teeth 165 so that the projections 108 will not engage the teeth 165 during the insertion of the strap 101 into the frame 120. Initial engagement between the strap 101 and the pawl 160 is with the lowermost one of the teeth 165, i.e., the tooth 165 disposed toward the entry surface 112, such engagement pivoting the pawl 160 in the clockwise direction as viewed in FIG. 9. During further tightening movement of the strap 101 as illustrated in FIG. 9, the teeth 115 on the strap 101 successively engage the lowermost one of the teeth 165 on the pawl 160, thereby to hold the pawl 160 generally in the position illustrated during tightening movement of the strap 101 through the frame 120. Preferably a tool such as that illustrated in the Caveney and Moody Patent No. 3,169,560, granted Feb. 16, 1965, or that illustrated in the Caveney and Moody U.S. Pat. No. 3,254,680, granted June 8, 1966, is utilized to tighten the strap 101 about the bundle 170, which tool automatically at the end of the tightening operation severs the strap 101 at a point disposed beyond the exit surface 130 of the frame 120, such as is illustrated by the arrows 174 in FIG. 10.

Immediately after severing of the strap 101, the tension in the portion of the strap 101 about the bundle 170 tends to withdraw the strap 101 from the frame 120 in the direction of the arrow 175, i.e., in a retrograde or strap-withdrawal or strap-loosening direction. During such movement of the strap 101 relative to the frame 120, the tooth 115 disposed toward the lowermost tooth 165 engages the lowermost tooth 165 and begins to pivot the pawl 160 in a counterclockwise direction from the position illustrated in FIG. 9 to that illustrated in FIG. 10. As the retrograde movement of the strap 101 continues, the teeth 165 above the lowermost tooth 165 progressively engage the teeth 115 of the strap 101, until all of the teeth 165 on the pawl 160 engage the adjacent ones of the teeth 115 on the strap 101. During this movement of the strap 101 in conjunction with the pawl 160, the projections 146 on the surface 142 are pressed in against the adjacent surface 113 of the strap 101 firmly to grip the same. The parts finally arrive in the position illustrated in FIG. 10, the position of the pawl 160 in FIG. 10 which illustrates the tensioned condition of the parts being essentially the same as that in the as-molded position illustrated in FIG. 7. With the parts in the positions illustrated in FIG. 10, the strap 101 is firmly gripped between the abutment wall 141 and the pawl 160, and specifically, the projections 146 on the strap-bearing surface 142 are in firm engagement with the surface 113 of the strap 101 while certain of the teeth 115 on the strap 101 are in firm locking engagement with the teeth 165 on the pawl 160.

It is noted that in the described operation of the pawl 160, during the insertion of the strap 101 into the frame 120, during the tensioning of the strap 101 about the bundle 170, and during the retrograde movement of the strap 101 to the final locked or tensioned position of FIG. 10, the pawl 160 is limited only to pivotal movement via the hinge 161 with respect to the frame 120 and about the connection to the ledge 150. It further is pointed out that the pawl 160 in the as-molded position thereof illustrated in FIG. 7 and in all of the other positions thereof including the flexed position of FIG. 9 and the tensioned position of FIG. 10 is disposed well within the frame 120 between the entry surface 112 and the exit surface 130 thereof. In other words, no part of the pawl 160 leaves the frame 120 during the application of the cable tie 100 about the bundle 170.

The channel in the front wall 141 provided by the surface 145 thereon and the inner surfaces 122 on the side walls 121 assists in the entry of the tip 103 into the throat 140 and also assists in permitting the frame 120 to lie more nearly flat against the associated bundle 170.

Once the parts are in the tensioned condition of FIG. 10, any force tending to withdraw the strap 101 from within the throat 140 in a strap-loosening direction serves to move the teeth 165 on the pawl 160 into more firm engagement with the engaged ones of the teeth 115 on the strap 101, and serves to move the projections 146 into more firm engagement with the surface 113 on the strap 101, thereby firmly to grip the strap 101 between the front wall 141 and the pawl 160. This described action prevents inadvertent withdrawal of the strap 101 from the frame 120, thus to lock the strap 101 in its tensioned condition about the bundle of wires.

Referring again to FIG. 7 of the drawings, it will be appreciated that the crests of the teeth 165 lie in a common surface, i.e., a plane, which common surface is disposed substantially equidistantly from the strap-bearing surface 142 along the length thereof both in the as-molded condition of the parts, and also in the tensioned condition of the parts. It further is pointed out that the strap-bearing surface 142 extends beyond the teeth 165 toward the entry surface 112 and is disposed opposite the majority of the teeth 165, thereby to provide a backing for the engaging portion of the strap 101 so that the corresponding engaged teeth 115 are encompassed thereby. All of the teeth 165 in the tensioned condition are engaged and loaded.

The surface 144 is relieved at least to a plane substantially normal to the longitudinal axis of the strap 101 as molded and is spaced from the pawl 160 toward the front wall 141. By relieving the surface 144 in this manner, it is possible to mold the teeth 165 on the pawl 160 provided that the teeth 165 and the other portions of the pawl 150 are properly shaped. More specifically, the planes defined by the surfaces of the teeth 165 disposed toward the entry surface 112, i.e., the surfaces 167, converge with the planes defined by the surfaces of the pawl 160 disposed toward the exit surface 130, i.e., the surfaces 163 and 164. The two sets of planes named converge at points disposed toward the exit side of the frame 120, convergence being at angles as small as zero degrees, i.e., the sets of planes may be essentially parallel. This convergence of the several surfaces permits the pawl 160 and the teeth 165 thereon to be properly molded as one piece with the remaining portion of the cable tie 100.

Referring to FIG. 9, it will be noted that even at the full clockwise position of the pawl 160 with respect to the frame 120, there is ample clearance between the rear surface 164 of the pawl 160 and the inner surface 132 of the end wall 131, thereby to permit unrestricted flexure of the pawl 160 during insertion of the strap 101 into the frame 120. This feature is important to prevent damage to the teeth 165 on the pawl 160 and to prevent tearing of the pawl 160 from the frame 120 during the insertion of the strap 101 through the frame 120.

In a constructional example of the cable tie 100 for use with bundles having a diameter of 1.25 inches, the overall length thereof is 5.62 inches, the width of the strap 101 is 0.135 inch, the thickness of the strap 101 is 0.035 inch, the length of the outer end 102 is 1.225 inches, the portion of the strap 101 carrying the teeth 115 has a length of 4.245 inches, the depth of the teeth 115 is 0.008 inch and the pitch thereof is 0.020 inch, the inclination of the surfaces 117 to the surface 112 being 22°; the dimension of the frame 120 in the direction of the strap 101 is 0.195 inch, the overall height of the frame 120 is 0.130 inch, the overall width of the frame 120 is 0.230 inch, the inclination of the surfaces 123, 133 and 143 is 5° and the inclination of the surface 132 is 3°; the surface 127 is inclined at an angle of 70° with respect to the longitudinal surface of the strap 101 as molded, the surface 142 is inclined at an angle of 66° with respect to the longitudinal axis of the strap as molded, while the surface 144 is substantially normal thereto; the uppermost tooth 165 is disposed 0.027 inch below the uppermost portion of the surface 130 and the juncture between the surfaces 138 and 169 is spaced 0.035 inch from the surface 112; the surface 158 is inclined at an angle of 60° with respect to the longitudinal axis of the strap 101 as molded and terminates at a point spaced 0.016 inch from the plane in which lies the surface 144; the distance between the surfaces 112 and 145 is 0.10 inch; the height of the projections 146 is 0.002 inch and the length thereof is 0.075 inch; the distance between the surface 122 is 0.145 inch, the distance between the surfaces 128 is 0.120 inch, the distance between the surfaces 156 is 0.100 inch, the distance between the surfaces 162 is 0.090 inch and the distance between the surfaces 136 is 0.085 inch.

There is illustrated in FIG. 13 of the drawings a second embodiment of an integral one-piece cable tie made in accordance with the present invention, the cable tie of FIG. 13 being generally designated by the numeral 200. Many of the parts of the cable tie 200 are identical in construction to like parts in the cable tie 100 described above, and accordingly, there has been applied to each part of the cable tie 200 a reference numeral in the 200 series corresponding to the reference numeral in the 100 series that was applied to the like part of the cable tie 100 described above.

The fundamental differences between the cable tie 200 of FIG. 13 and the cable tie 100 described above is in the ledge 250 and the construction of the lower portion of the pawl 260. Furthermore, the projections 135 and 155 of the cable tie 100 have been eliminated. It will be noted that there is provided on the pawl 260 a front surface 268 disposed substantially normal to the longitudinal axis of the strap 201 as molded, the lower edge of the surface 268 joining a bottom surface 269 on the pawl 260. The bottom surface 269 is disposed substantially parallel to the longitudinal axis of the strap 201 as molded and joins the surface 238 at a curved juncture. The hinge 261 not only extends downwardly to the ledge 250 but also extends rearwardly to the surface 251, all as illustrated.

There is illustrated in FIGS. 14 to 16 of the drawings a third embodiment of an integral one-piece cable tie made in accordance with the present invention, the cable tie of FIGS. 14 to 16 being generally designated by the numeral 300. Many of the parts of the cable tie 300 are identical in construction to like parts in the cable ties 100 and 200 described above, and accordingly, there has been applied to each part of the cable tie 300 a reference numeral in the 300 series corresponding to the reference numeral in the 100 series or 200 series, as the case may be, that was applied to the like part of the cable tie 100 or the cable tie 200, again as the case may be.

The shape of the pawl 360 is much like that of the pawl 260, except that the upper surface 363 thereof is inclined upwardly and away from the strap 301; there also has been provided a greater number of teeth. There are no rails provided in the cable tie 300 corresponding to the rails 125 and 225 in the cable ties 100 and 200, respectively. There likewise are no projections on the surface 342 corresponding to the projections 146 and 246 on the surfaces 142 and 242, respectively. Furthermore, the surface 342 continues upwardly to the exit surface 330, there being no relieved surface such as the surfaces 144 and 244 on the cable ties 100 and 200 respectively.

From the above, it will be seen that there have been provided improved cable ties which fulfill all of the objects and advantages set forth above.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition, and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

2. The integral one-piece cable tie set forth in claim 1, and further comprising a transversely extending ridge on the other surface of said strap and engagable with said frame temporarily to hold said strap about a bundle during the assembly of said strap about the bundle.

3. The integral one-piece cable tie set forth in claim 1, and further comprising two rows of gripping projections on said one side of said strap at the free end thereof, said rows of projections being spaced-apart a distance greater than the width of said tooth.

4. The integral one-piece cable tie set forth in claim 1, wherein said frame has a channel therein through said abutment wall for receiving the other end of said strap thus to permit said frame to lie more nearly flat against the associated bundle of wires.

5. The integral one-piece cable tie set forth in claim 1, wherein said end wall is relatively thicker adjacent to said entry surface and is relatively thinner adjacent to said exit surface in the direction disposed longitudinally of said strap, said ledge being disposed on said end wall at the thicker portion thereof.

6. The integral one-piece cable tie set forth in claim 1, wherein the normal tensioned position of said pawl is substantially the as-molded position thereof.

7. An integral one-piece cable tie to be tensioned about a bundle of wires and the like, said cable tie comprising an elongated flexible strap, a row of teeth disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, the crests of a plurality of the teeth in said set of teeth being positioned opposite said strap-bearing surface and lying in a common surface that is disposed substantially equidistantly from said strap-bearing surface, said strap-bearing surface extending beyond said plurality of teeth, the planes defined by surfaces of said set of teeth disposed toward said entry surface in the tensioned condition converging with the planes defined by the surface of said pawl disposed toward said exit surface and away from said abutment wall in the tensioned condition at points disposed on the exit side of said frame at angles as small as zero degrees, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

8. An integral one-piece cable tie to be tensioned about a bundle of wires and the like, said cable tie comprising an elongated flexible strap, a row of teeth disposed on one longitudinal surface of said strap and arranged transversely with respect thereto, a frame integral with one end of said strap and including an end wall and an abutment wall, said frame having an entry surface and an exit surface and a strap-receiving opening extending therethrough, a pawl disposed within said frame in said strap-receiving opening and pivotally mounted on and integral with said end wall, said abutment wall having a strap-bearing surface disposed toward said pawl and defining therewith a strap-receiving throat, a set of teeth on said pawl arranged transversely with respect thereto and disposed toward said abutment wall and shaped to engage said row of teeth on said strap, the portion of said abutment wall disposed toward said entry surface and the longitudinal axis of said strap-receiving throat and the plane containing the crests of said set of teeth all being inclined at acute angles less than 90° with respect to the longitudinal axis of said strap as molded, the portion of said strap-bearing surface disposed adjacent to said exit surface being relieved at least to a plane substantially normal to the longitudinal axis of said strap as molded and spaced from said pawl so that a plurality of said set of teeth are opposite the inclined portion of said strap-bearing surface, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

9. The integral one-piece cable tie set forth in claim 8, and further comprising a plurality of strap-gripping projections on the portion of said strap-bearing surface of said abutment wall disposed toward said entry surface and extending toward said pawl.

10. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a pawl disposed within said frame in said strap-receiving opening and pivotally mounted on and integral with said end wall, said abutment wall having a strap-bearing surface disposed toward said pawl and defining therewith a strap-receiving throat, a tooth on said pawl arranged transversely with respect thereto and disposed toward said abutment wall and shaped to engage said row of abutments on said strap, and a plurality of strap-gripping projections on said strap-bearing surface between said entry and exit surfaces and opposite to and extending toward said pawl, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments and to press said strap-gripping projections against said strap firmly to grip said strap between said strap-bearing surface and said pawl, whereby to prevent inadvertent withdrawal of said strap from said frame and thus to lock said strap in its tensioned condition about the bundle of wires.

11. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, rails respectively disposed on said frame adjacent to said end wall and extending into said strap-receiving opening at positions to guide said strap along a path adjacent to said strap-bearing surface, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

12. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, a tooth on said pawl arranged transversely with respect thereto and disposed toward said abutment wall and shaped to engage said row of abutments on said strap, and a plurality of strap-gripping projections on said strap-bearing surface between said entry and exit surfaces and opposite to and extending toward said pawl, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition, any force tending to withdraw said strap from within said strap-receiving throat in a strap-loosening direction serving to move said tooth into more firm engagement with the engaged ones of said row of abutments and to press said strap-gripping projections against said strap firmly to grip said strap between said strap-bearing surface and said pawl, whereby to prevent inadvertent withdrawal of said strap from said frame and thus to lock said strap in its tensioned condition about the bundle of wires.

13. An integral one-piece cable tie to be tensioned about a bundle of wires and the like, said cable tie comprising an elongated flexible strap, a row of abutments disposed on one longitudinal surface of said strap and arranged transversely with respect thereto, a frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, a plurality of strap-gripping projections on said strap-bearing surface between said entry and exit surfaces and opposite to and extending toward said pawl, rails respectively disposed on said frame adjacent to said end wall and extending into said strap-receiving opening at positions to guide said strap along a path adjacent to said strap-bearing surface and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments and to press the said strap-gripping projections against said strap firmly to grip said strap between said strap-bearing surface and said pawl, whereby to prevent inadvertent withdrawal of said strap from said frame and thus to lock said strap in its tensioned condition about the bundle of wires.

14. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an opening entry surface and an opening exit surface and a strap-receiving opening extending therethrough, said exit surface sloping toward said entry surface in a direction away from said strap, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a set of teeth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

15. The integral one-piece cable tie set forth in claim 14, wherein in the tensioned condition of said strap the crests of a plurality of the teeth in said set of teeth are positioned opposite said strap-bearing surface and lying in a common surface that is disposed substantially equidistant from said strap-bearing surface, and said strap-bearing surface extends beyond said plurality of teeth.

16. An integral one-piece cable tie to be tensioned about a bundle of wires and the like, said cable tie comprising an elongated flexible strap, a row of teeth disposed on one longitudinal surface of said strap and arranged transversely with respect thereto, a frame integral with one end of said strap and including an end wall and an abutment wall, said frame having an entry surface and an exit surface and a strap-receiving opening extending therethrough, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited substantially to pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a set of teeth on said pawl arranged transversely with respect thereto and disposed toward said abutment wall and shaped to engage said row of teeth on said strap, said strap being deformable into a loop encircling a bundle of wires with the free end of said strap extending into said strap-receiving throat and through the opening in said frame and therebeyond, said set of teeth being disposed toward said row of teeth as said strap is tensioned about the bundle of wires to a tensioned condition and release of said strap causing at least certain ones of said row of teeth firmly to engage said set of teeth, the crest-to-crest distance of said set of teeth being slightly less than the crest-to-crest distance of said row of teeth so that when the tooth in said set of teeth disposed toward said entry surface is the first to engage one of said row of teeth all of the teeth in said set of teeth will ultimately engage teeth in said row of teeth, any force tending to withdraw said strap from within said strap-receiving throat in a strap-loosening direction serving to move said set of teeth into more firm engagement with the engaged ones of said row of teeth firmly to grip said strap between said strap-bearing surface and said pawl, whereby to prevent inadvertent withdrawal of said strap from said frame and thus to lock said strap in its tensioned condition about the bundle of wires.

17. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

18. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an opening entry surface and an opening exit surface and an opening extending therethrough for receiving the other end of said strap, said exit surface sloping toward said entry surface in a direction away from said strap, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

19. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, a tooth on said pawl arranged transversely with respect thereto and disposed toward said abutment wall and shaped to engage said row of abutments on said strap, and a plurality of strap-gripping projections on said strap-bearing surface between said entry and exit surfaces and opposite to and extending toward said pawl, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition, any force tending to withdraw said strap from within said strap-receiving throat in a strap-loosening direction serving to move said tooth into more firm engagement with the engaged ones of said row of abutments and to press said strap-gripping projections against said strap firmly to grip said strap between said strap-bearing surface and said pawl, whereby to prevent inadvertent withdrawal of said strap from said frame and thus to lock said strap in its tensioned condition about the bundle of wires.

20. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall and including a support surface disposed toward said entry surface, a pawl disposed within said frame in said strap-receiving opening between said ledge and said exit surface, a hinge interconnecting the support surface of said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

21. A cable tie to be tensioned about a bundle of wires and the like, said cable tie comprising an elongated flexible strap, a row of abutments disposed on the longitudinal surface of said strap disposed against the bundle of wires in use, said abutments being arranged transversely with respect to the longitudinal axis of said strap, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening between said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

22. A cable tie to be tensioned about a bundle of wires and the like, said cable tie comprising an elongated flexible strap, a row of abutments disposed on one longitudinal surface of said strap and arranged transversely with respect thereto, a frame on one end of said strap and including an end wall and an abutment wall, said frame having an entry surface and an exit surface and an opening extending therethrough for receiving the other end of said strap, a ledge on said end wall extending longitudinally therefrom toward said abutment wall, a pawl disposed within said frame in said strap-receiving opening between said ledge and said exit surface, a hinge interconnecting said ledge and said exit surface, a hinge interconnecting said ledge and the end of said pawl disposed toward said entry surface, the longitudinal extent of said hinge being less than the longitudinal extent of said ledge at the junction therebetween, the longitudinal cross-sectional area of said hinge being less than the longitudinal cross-sectional area of said pawl at the junction therebetween, said pawl and said hinge cooperating so that said pawl is limited to substantially pivotal movement with respect to said frame about the connection to said ledge, said pawl in the as-molded position thereof and in all other positions thereof including the tensioned position thereof being disposed entirely within said frame between the entry and exit surfaces thereof, said abutment wall having a strap-bearing surface disposed toward said pawl and defining therewith a strap-receiving throat, and a set of teeth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, said set of teeth being disposed toward said row of abutments as said strap is tensioned about the bundle of wires to a tensioned condition and release of said strap causing at least certain ones of said abutments firmly to engage said set of teeth, the crests of a plurality of the teeth in said set of teeth being positioned opposite said strap-bearing surface in the tensioned condition of said strap with said strap-bearing surface extending beyond said plurality of teeth, any force tending to withdraw said strap from within said strap-receiving throat in a strap-loosening direction serving to move said teeth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

* * * * *

UNITED STATES PATENT AND TRADEMARK OFFICE

CERTIFICATE OF CORRECTION

PATENT NO. : 3,965,538

DATED : June 29, 1976

INVENTOR(S) : Jack E. Caveney and Roy A. Moody

It is certified that error appears in the above-identified patent and that said Letters Patent are hereby corrected as shown below:

[56] "2,484,905" should be --3,484,905--.
Column 3, line 31, "as" should be --or--.
Column 8, line 43, "surface" should be --surfaces--.
Column 17, line 64, after "engage" insert --said tooth, any force tending to withdraw said strap--.
Column 20, line 25, after "surface," delete "a hinge interconnecting said ledge and said exit surface,"

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*

Disclaimer 3,965,538.—*Jack E. Caveney,* Chicago; and *Roy A. Moody,* Flossmoor, Ill. INTEGRAL CABLE TIE. Patent dated June 29, 1976. Disclaimer filed Dec. 23, 1981, by the assignee, *Panduit Corp.*

The term of this patent subsequent of Mar. 25, 1992 has been disclaimed.

[*Official Gazette September 14, 1982.*]